US007258315B2

(12) United States Patent
Wamsley

(10) Patent No.: US 7,258,315 B2
(45) Date of Patent: Aug. 21, 2007

(54) FOLDABLE SIGN HOLDER

(75) Inventor: Stephen D. Wamsley, Lakewood, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 17 days.

(21) Appl. No.: 10/767,942

(22) Filed: Jan. 29, 2004

(65) Prior Publication Data

US 2005/0167555 A1 Aug. 4, 2005

(51) Int. Cl.
*E04G 5/06* (2006.01)

(52) U.S. Cl. ..... 248/231.81; 248/216.1; 248/227.4; 40/657

(58) Field of Classification Search ..... 248/231.81, 248/230.4, 231.51, 227.4, 228.4, 222.13, 248/223.41, 229.1, 229.13, 229.16; 24/595.1; 211/140, 87.01; 40/657
See application file for complete search history.

(56) References Cited

U.S. PATENT DOCUMENTS 2,215,139 A * 9/1940 Uhlmann ..... 24/543
3,324,585 A * 6/1967 Frederickson ..... 40/658
3,494,072 A * 2/1970 Olson ..... 47/44
3,526,935 A 9/1970 Boyce et al.
3,728,806 A * 4/1973 Kostiuk ..... 40/658
3,729,780 A * 5/1973 White ..... 24/704.2
3,739,525 A * 6/1973 Rybak ..... 47/44
D234,204 S * 1/1975 Miller et al. ..... D24/145
4,378,617 A * 4/1983 Burns ..... 24/336
4,506,856 A * 3/1985 Rich et al. ..... 248/220.31
4,514,882 A * 5/1985 Lavielle ..... 24/16 PB
4,526,756 A * 7/1985 Wong ..... 422/104
4,536,924 A * 8/1985 Willoughby ..... 24/487
4,807,334 A * 2/1989 Blanchard ..... 24/487
5,313,721 A * 5/1994 Filden ..... 40/1.6
5,375,803 A 12/1994 Kump
5,377,940 A * 1/1995 Cabe et al. ..... 248/74.3
5,862,917 A * 1/1999 Noble et al. ..... 206/600
6,131,859 A * 10/2000 Giuliano ..... 248/62

(Continued)

OTHER PUBLICATIONS

FFR Yellow Pages® 2002 Product Catalog, Front Cover, pp. 10, 82, 93, 101 and back cover.

*Primary Examiner*—Anita M. King
(74) *Attorney, Agent, or Firm*—Fay Sharpe LLP

(57) ABSTRACT

A holder for planar material includes a first panel and a second panel hingedly connected to the first panel. A prong is secured to the first panel and extends in a direction approximately normal thereto. The prong has a pointed tip. An aperture is defined in the second panel. The pointed tip pierces an associated planar material located between the panels such that the prong of the first panel can pass through the associated planar material and enter the aperture of the second panel when the first panel overlies a portion of the second panel, thereby holding the associated planar material between the first and second panels. A clip is connected to at least one of the first and second panels. The clip allows the holder to be mounted to an associated support. In another embodiment, each of the first and second panels includes an extension and a hinge connects the first and second extensions thereby allowing the first panel, and the first extension, to be pivoted in relation to the second panel and the second extension. This enables the holder to be selectively mounted on a wire component of an associated support.

24 Claims, 7 Drawing Sheets

U.S. PATENT DOCUMENTS 6,164,604 A * 12/2000 Cirino et al. ..... 248/74.3
D440,606 S * 4/2001 Mueller ..... D20/43
6,311,935 B1 * 11/2001 Mullen, Jr. ..... 248/74.1
D454,917 S 3/2002 Mueller
6,354,546 B1 * 3/2002 Mueller ..... 248/220.42
6,357,711 B1 * 3/2002 Heyderman et al. ... 248/288.31
6,726,166 B2 * 4/2004 Goodman ..... 248/229.14
D496,693 S * 9/2004 Mueller ..... D20/43
6,932,226 B2 * 8/2005 Hardy ..... 211/119.003

* cited by examiner

FOLDABLE SIGN HOLDER

BACKGROUND OF THE INVENTION

This invention relates generally to sign holders. More particularly, the present invention relates to a holder for planar or sheet material wherein the holder has a pair of hingedly connected panels and a prong on one panel which is adapted to pass through a hole in the other panel.

The invention is particularly applicable to holders or display devices useful in a retail environment where price sheets or other signs need to be displayed to purchasers. However, it should be appreciated by those skilled in the art that the invention has broader applications and may also be adapted for use in many other environments, such as holding a plurality of sheets together or holding a display fixture to a support.

It is conventional practice in retail establishments to indicate the price of merchandise held on shelves with price sheets being mounted to the shelf adhesively or with some type of support or clip. The price sheet may be positioned in a plane parallel to the front edge of a shelf or a peg board type display or in a plane perpendicular to the front edge to call the buyer's attention to the goods.

It is desirable that sheets be mounted securely to prevent accidental or mischievous dislodgement. Previously known clips accomplish this through mechanical locking means. For example, a pin and slot arrangement or gripping teeth would prevent the removal of the sheet except by manually disengaging the locking means. Some such clips are made from several parts to facilitate the removal of sheets. However, such devices are more costly to produce than is a one piece device.

A known one-piece clip includes first and second panels that are hingedly connected to each other. One of the panel members includes a prong which extends through an aperture in the other panel member thereby impaling a sheet of planar material therebetween. Such a design is illustrated in U.S. Pat. No. 5,375,803, which issued on Dec. 27, 1994. However, this known design is only useful for a limited range of retail displays, namely C channels. It would be desirable to adapt a similar type of one piece sign holder for use in connection with metal and plastic scan plates, such as are used in peg board displays and in connection with wire baskets and similar wire-type merchandising and displays.

Also known to the art is a ticket holder which employs first and second panels that are hingedly connected to each other and can be secured together via a toothed prong. Each of the first and second panels has a respective extension rigidly mounted thereto. The prong is mounted on the first extension. The first extension is hingedly connected to the second extension and pivots in relation thereto. When the panels and extensions are folded, the prong protrudes through aligned apertures formed in the first and second panels. Such a design of a ticket holder can be found in Design Pat. No. D440,606 which issued on Apr. 17, 2001. In this design, the planar material or ticket is held between the two panels but is not pierced by the prong. Rather, the prong is spaced away from the area of the two panels between which the ticket is held. Thus, the ticket is liable to fall out of the holder, since it is not positively locked to the holder.

Accordingly, it has been considered desirable to develop a new and improved holder for planar sheet material which would overcome the foregoing difficulties and others while providing better and more advantageous overall results.

BRIEF SUMMARY OF THE INVENTION

In accordance with the present invention, a holder for planar material is provided.

More particularly, in accordance with one aspect of the invention, the holder includes a first panel and a second panel hingedly connected to the first panel. A prong is secured to the first panel and extends in a direction approximately normal thereto. The prong has a pointed tip. An aperture is provided in the second panel wherein the pointed tip pierces an associated planar material so that the prong of the first panel can pass through the associated planar material and enter the aperture of the second panel when the first panel overlies a portion of the second panel, thereby holding the associated planar material between the first and second panels. A clip is connected to at least one of the first and second panels. The clip allows the holder to be mounted to an associated support.

In accordance with another aspect of the present invention, a holder for planar material comprises a first panel including a first extension and a second panel including a second extension. A hinge connects the first and second extension thereby allowing the first panel, and the first extension, to be pivoted in relation to the second panel and the second extension. This enables the holder to be selectively mounted on a wire component of an associated support. A first reinforcing rib protrudes from at least one of the first panel and a first extension and the second panel and the second extension.

Other benefits and advantageous of the invention will become apparent to those skilled in the art upon a reading and understanding of the following detailed specification.

BRIEF DESCRIPTION OF THE DRAWINGS

The invention may take physical form in certain parts and arrangements of parts, several embodiments of which will be described in detail in this specification and illustrated in the accompanying drawings which form a part hereof and wherein.

DETAILED DESCRIPTION OF THE PREFERRED EMBODIMENTS

Figure 1:
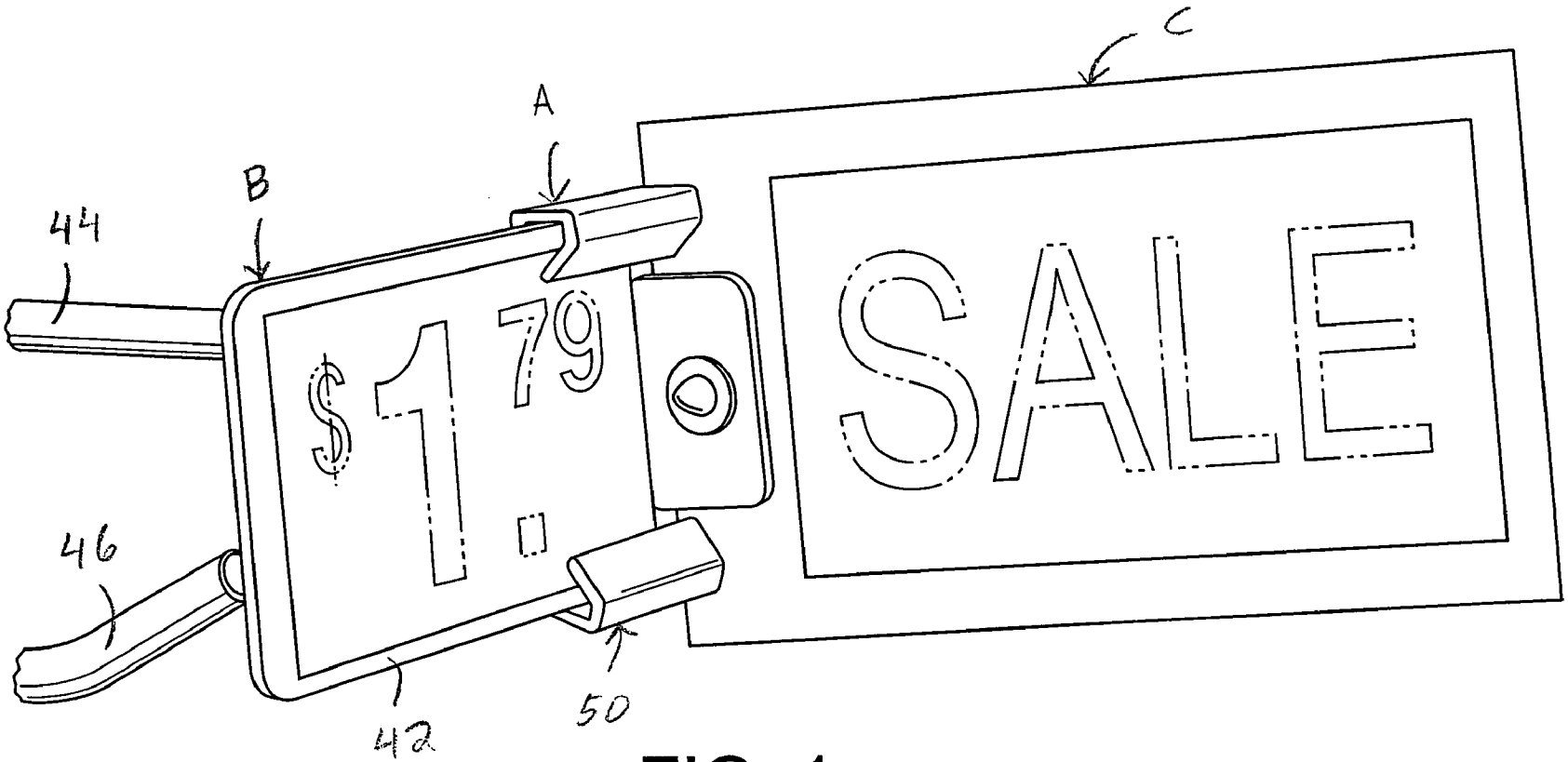
FIG. 1 is a perspective view of a holder for planar material according to a first embodiment of the present invention as mounted to a scan plate.

Referring now to the drawings wherein the showings are for purposes of illustrating several preferred embodiments of the invention only and not for purposes of limiting same, FIG. 1 shows a holder A for planar material. While the holder is primarily designed for and will hereinafter be described in connection with a retail environment in which a sheet of material is displayed to purchasers, it should be appreciated that the holder can also be used in other environments. In the environment illustrated in FIG. 1, the holder A is shown as being mounted on a support B in the form of a scan plate.

Figure 2:
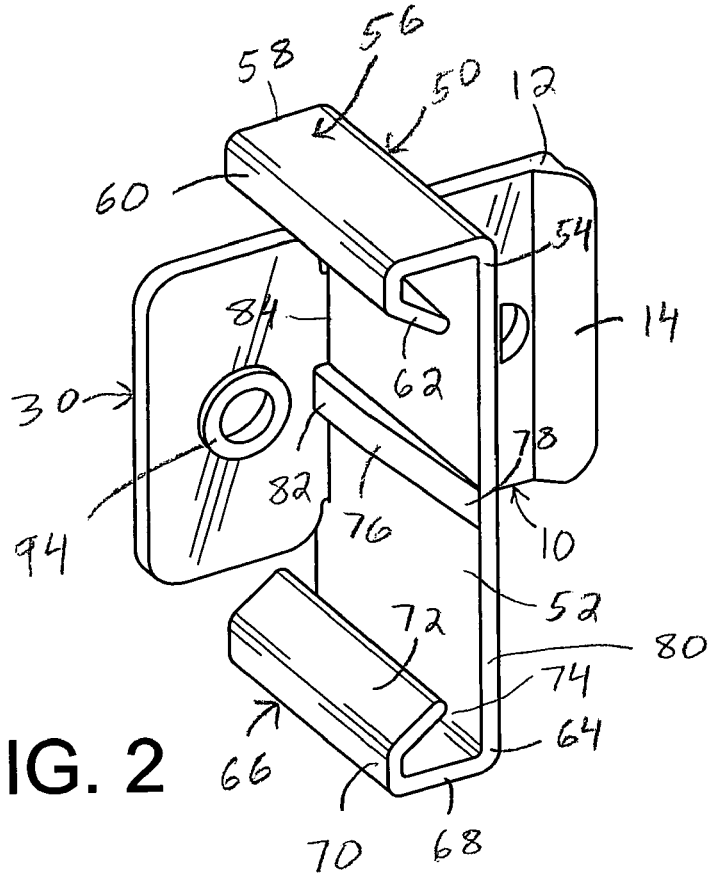
FIG. 2 is a front perspective view of the holder of FIG. 1 in an unfolded orientation.
Figure 3:
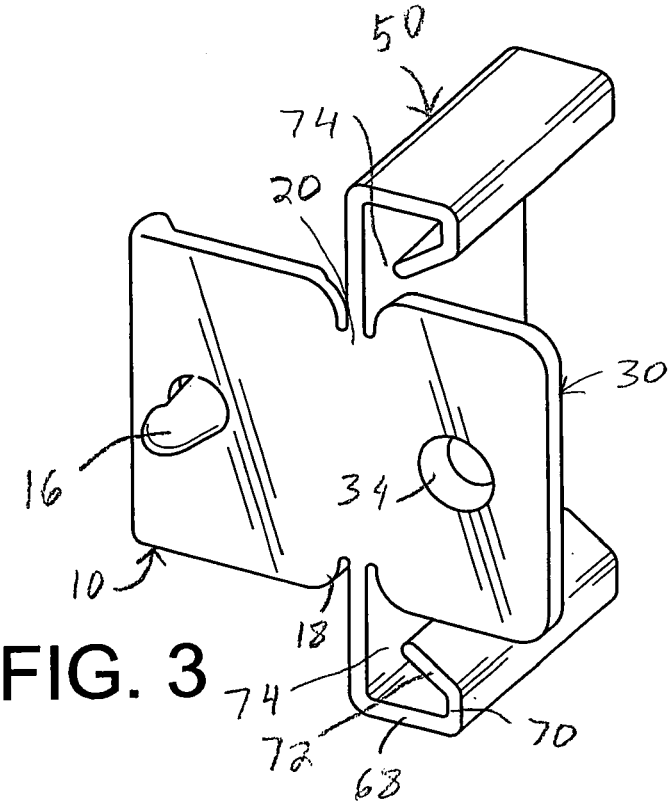
FIG. 3 is a rear perspective view of the holder of FIG. 1 in an unfolded orientation.
Figure 4:
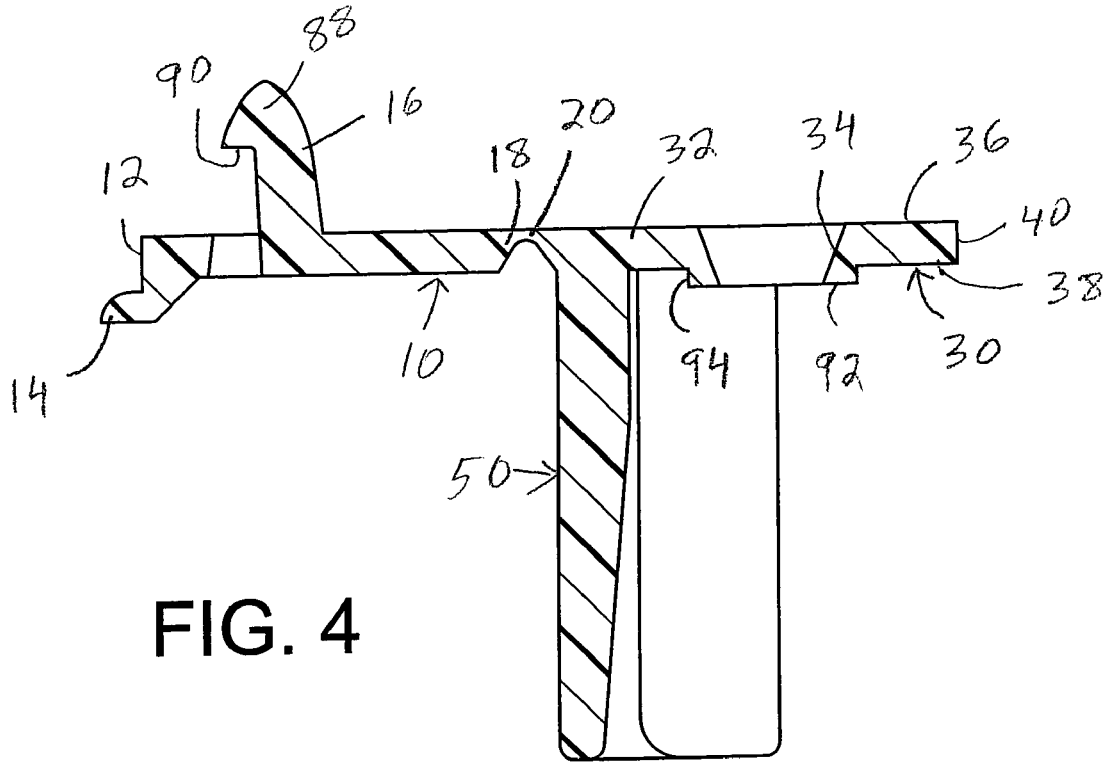
FIG. 4 is an enlarged top plan view in section of the holder of FIG. 1 in an unfolded orientation.

With reference now to FIG. 2, the holder A comprises a first panel 10 having a first end edge 12 on which is located a tab portion 14. As better shown in FIG. 3, the first panel 10 further comprises a preferably integral prong 16 which extends approximately normal to the plane of the first panel. The first panel further comprises a second end edge 18 along which is defined a hinge member 20. If so desired, the hinge member 20 can be a living hinge. With reference now also to FIG. 4, the hinge member 20 connects the first panel 10 to a second panel 30 along a first end edge 32 thereof. Located in the second panel 30 is an aperture 34 which extends from a front face 36 to a rear face 38 thereof. Further provided on the second panel is a second end edge 40.

With reference again to FIG. 1, the holder A is mounted on the support B. In this embodiment, the support B comprises a scan plate 42 of a support mounted to a pegboard or the like (not illustrated). The scan plate 42 is located at the distal end of a plate support bar 44. Positioned below the support bar 44 is a product support bar 46 on which packages (not illustrated) are hung for purchase by customers.

Extending from the rear face 38 of the second panel 30 adjacent the first end edge 32 thereof is a clip 50. With reference again to FIG. 2, the clip includes a base wall 52 having a first end 54. Positioned on the first end is a first arm 56. The first arm comprises a first portion 58 that extends approximately normal to the plane of the base wall 52. A second portion 60 extends approximately parallel to the plane of the base and is spaced therefrom by the first portion 58. A third portion 62 of the arm extends at an acute angle in relation to the second portion. It should be evident that the third portion extends back towards the base wall 52 but terminates short of the base wall.

Located on a second end 64 of the base wall 52 is a second arm 66. As with the first arm, the second arm comprises a first portion 68 which extends approximately normal to the plane of the base wall. The second arm 66 also includes a second portion 70 which extends approximately parallel to the plane of the base wall. A third portion 72 extends at an acute angle in relation to the second portion back towards the base wall 52.

As is evident from FIG. 2, the first and second arms 56, 66 thus define respective slots 74 between the base wall and the arm third portions. The slots are meant to accommodate the thickness of the scan plate 42. In this way, the clip 50 can be selectively mounted on the scan plate. In fact, the slots can be somewhat less in dimension than the thickness of the scan plate. Since the holder A is desirably made from a sufficiently resilient material, the arms can flex somewhat as the clip 50 is mounted on the scan plate 42. In this way, a frictional engagement of the clip 50 with the scan plate 42 is facilitated.

In order to further prevent the clip 50 from becoming detached from the scan plate 42, a ramp 76 can be provided on the base wall 52. As is evident from FIG. 2, the ramp includes a first or lower end 78 located adjacent a first side edge 80 of the base wall 52 and a second or higher end 82 located adjacent a second side edge 84 of the base wall 52. With the presence of the ramp, a relatively tight frictional fit is thus provided between the clip 50 and the scan plate 42.

Figure 5:
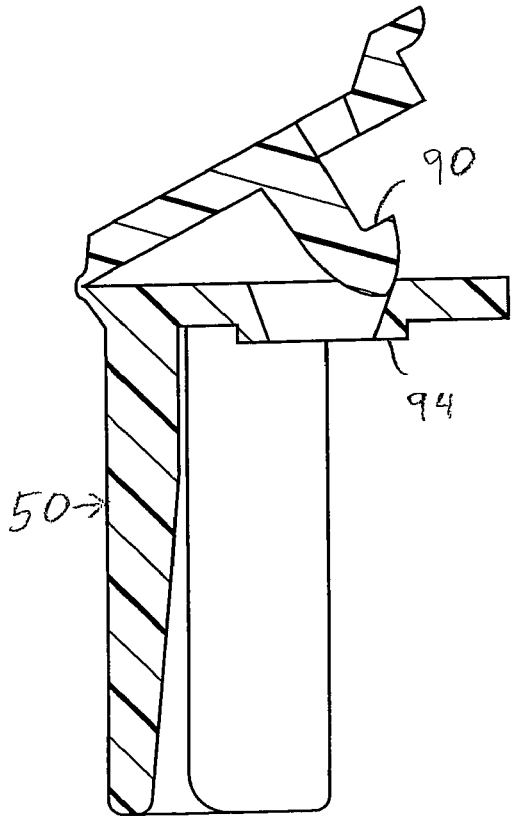
FIG. 5 is an enlarged top plan view in section of the holder of FIG. 1 while a first panel is being folded over a second panel.

With reference again to FIG. 4, the prong 16 located on the first panel 10 includes an enlarged head 88 defined by a shoulder 90. It is also evident that in this embodiment, the aperture 34 in the second panel 30 can be tapered from the front surface 36 to the rear surface 38 thereof. The aperture can extend in a thickened section 92 of the second panel so as to form a shoulder 94 on the second panel rear surface 38. As best seen in FIG. 5, the prong 16 can be so sized and located in relation to the aperture 34 that when the first panel 10 is rotated towards the second panel 30, the prong will enter the aperture. To lock the first panel 10 to the second panel 30, the prong shoulder 90 engages the rear surface of the second panel. More particularly, the prong shoulder 90 can engage the shoulder 94 defined on the thickened section 92 of the second panel 30.

The holder A can be made of one piece such that the first and second panels 10, 30 and the clip 50 are integral. These elements can be made of a single piece of resilient material such as a plastic. To this end, the holder A may be manufactured by injection molding from a suitable thermoplastic material, such as polypropylene.

With reference again to FIG. 1, the holder A is particularly adapted to be mounted to the scan plate 42 of the support B. When the first panel 10 is rotated around the hinge 20 towards the second panel 30, the prong 16 thereof will enter the aperture 34 and extend therethrough. If a sheet of planar material C is brought adjacent the second panel 30 before the first panel is rotated, the prong 16, as it is rotated, will pierce the sheet and subsequently enter the aperture 34 of the second panel. In this way, the sheet C is secured to the holder A. Once this is accomplished, the holder A can be mounted to the support B via the clip such that the first and second arms 56 and 66 of the clip 50 contact the scan plate 42 and mount the holder A to the support B.

To disengage the prong 16 from the second panel 30 when the sheet C is to be removed, one merely needs to pull on the tab 14 of the first panel. Due to the resiliency of the material from which the holder A can be manufactured, the prong 16 will be pulled in such a manner as to disengage the shoulder 90 from the shoulder 94. Thereafter, the first panel 10 can be rotated around the hinge member 20 in relation to the second panel 30 so as to remove the prong 16 from the aperture 34. Thereafter, the sheet C can be removed and, if desired, replaced with another sheet of advertising material or signage.

Figure 6:
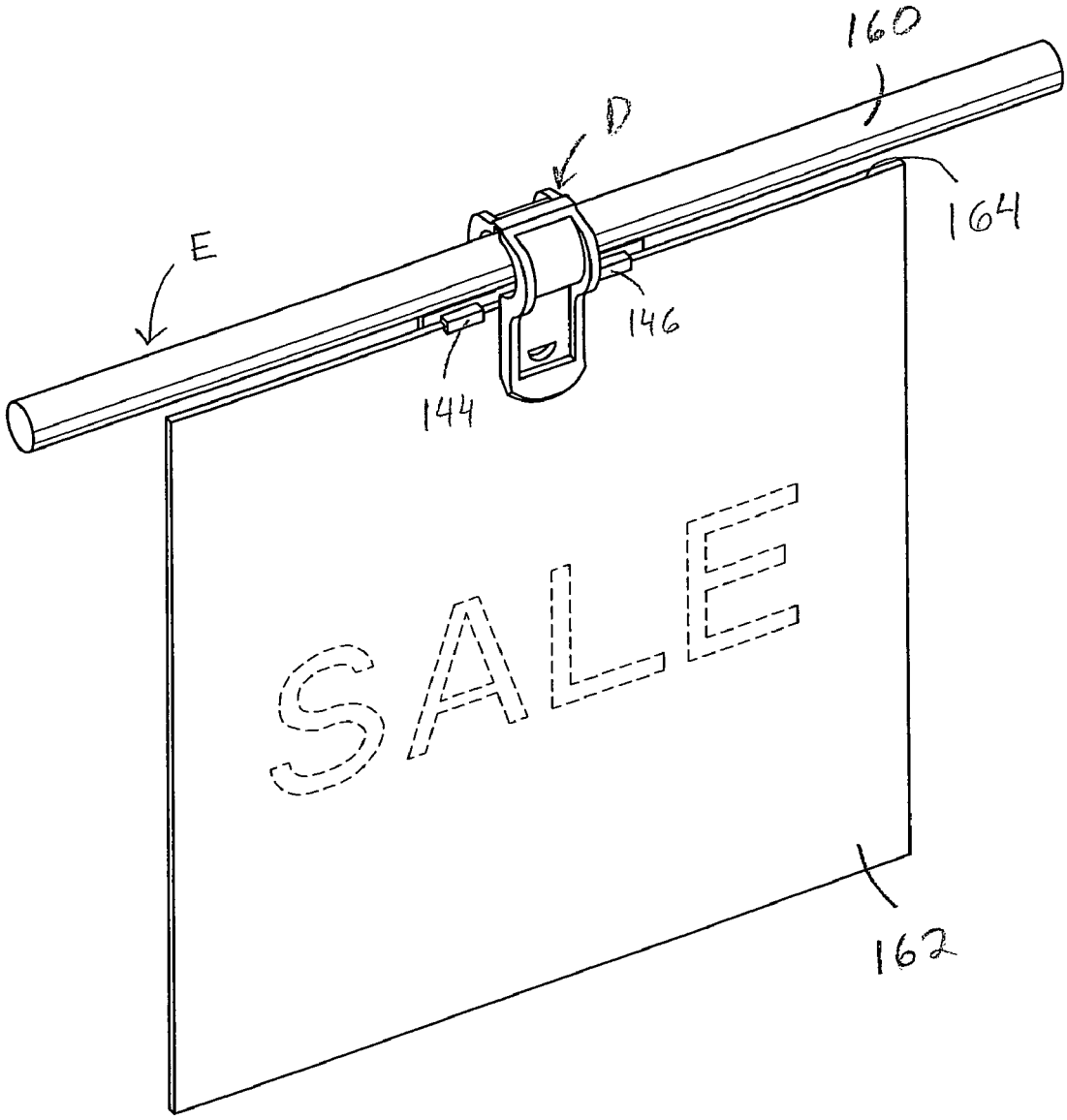
FIG. 6 is a perspective view of a holder for planar material according to a second embodiment of the present invention as mounted on a wire of an associated merchandising display.
Figure 7:
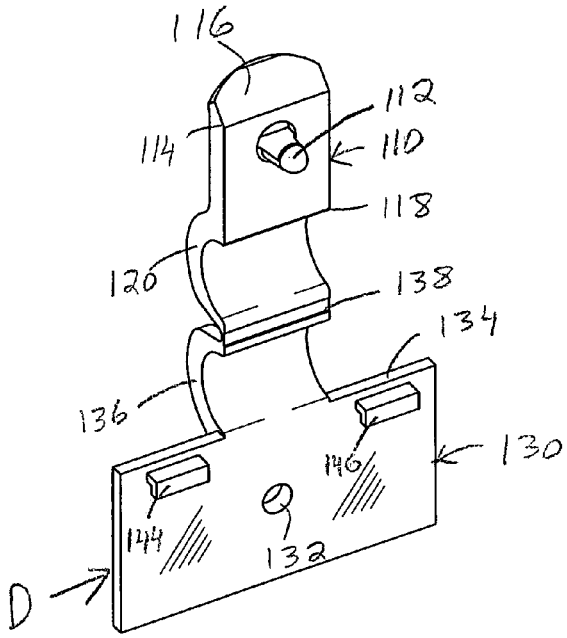
FIG. 7 is an enlarged front perspective view of the holder of FIG. 6 in an unfolded condition.
Figure 8:
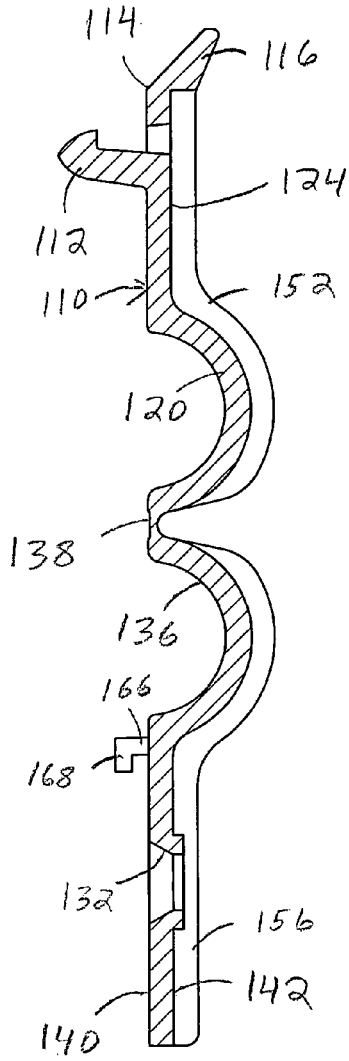
FIG. 8 is an enlarged cross sectional view of the holder of FIG. 7.

With reference now to FIG. 6, another holder D is there illustrated. In this embodiment, and with reference now to FIG. 7, the holder D comprises a first panel 110 extending from which is a prong 112 in a plane approximately normal to the plane of the panel. The panel includes a first end edge 114 on which is defined a tab 116. Also, the first panel includes a second end edge 118, protruding from which is a first extension 120. The holder D further includes a second panel 130 in which is defined an aperture 132. The second panel includes a first end edge 134 from which protrudes a second extension 136. In this embodiment, the first and second extensions 120 and 136 are connected by a living hinge 138. As shown in FIG. 8, the aperture 132 in the second panel extends from the first side 140 to a second side 142 thereof. Positioned on the first side 140 is a first overhang 144. Spaced therefrom is a second overhang 146, as is best seen in FIG. 7.

Figure 9:
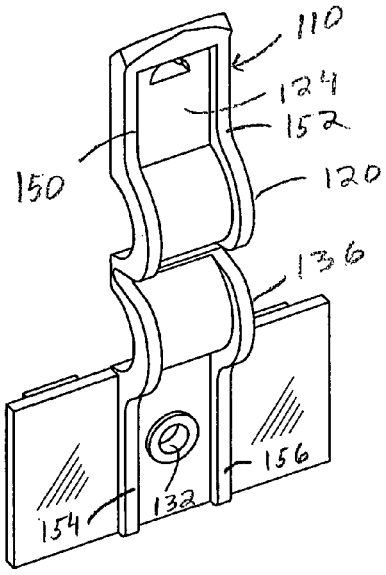
FIG. 9 is a rear perspective view of the holder of FIG. 7.

With reference now to FIG. 9, positioned on the second side 124 of the first panel is a first reinforcing rib 150. The rib can extend parallel to a longitudinal axis of the first panel and the first extension 120. Extending parallel to the first reinforcing rib 150 is a second reinforcing rib 152. It is apparent that the two reinforcing ribs are located adjacent opposing side edges of the first extension 120. Similarly, located on the second panel 130 and second extension 136 are third and fourth reinforcing ribs 154 and 156. These ribs stiffen the two panels 110 and 130, as well as the two extensions 120 and 136. Such stiffening is useful to enable the holder to better resist the forces exerted on it while it is being manipulated during the process of securing a sign to a merchandising fixture.

It should be apparent from FIG. 8 that the first and second extensions 120 and 136 are each approximately semi-circular in shape. Thus, when the first panel 110, and its first extension 120, are pivoted in relation to the second panel 130 and its extension 136, they form an approximately cylindrical holder. This enables the sign holder to be mounted on a wire 160 of a fixture E, shown in FIG. 6.

When the first panel 110 is brought adjacent the second panel 130, the prong 112 will enter the aperture 132 and extend therethrough. If a sheet of planar material 162 is brought adjacent the second panel 130 before the first panel is rotated, then the prong 112 will pierce the sheet, during the process of folding the first panel over the second panel, and subsequently enter the aperture 132 of the second panel. In this way, the sheet 162 is secured to the holder D. In order to ensure that the sheet 162 does not protrude into the semi-circular extension 136 of the second panel 130, the overhangs 144 and 146 correctly locate an upper edge 164 of the sheet 162. While two overhangs 144 and 146 are illustrated in FIG. 7, it should be appreciated that a single overhang rib or the like could be employed instead to serve as a stop element for the upper edge 164 of the sheet 162. In the embodiment illustrated, and with reference again to FIG. 8, the overhang includes a first leg 166 which protrudes approximately perpendicular from the first side 140 of the second panel 130 and a second leg 168 which extends approximately parallel to the second panel 130.

Figure 10:
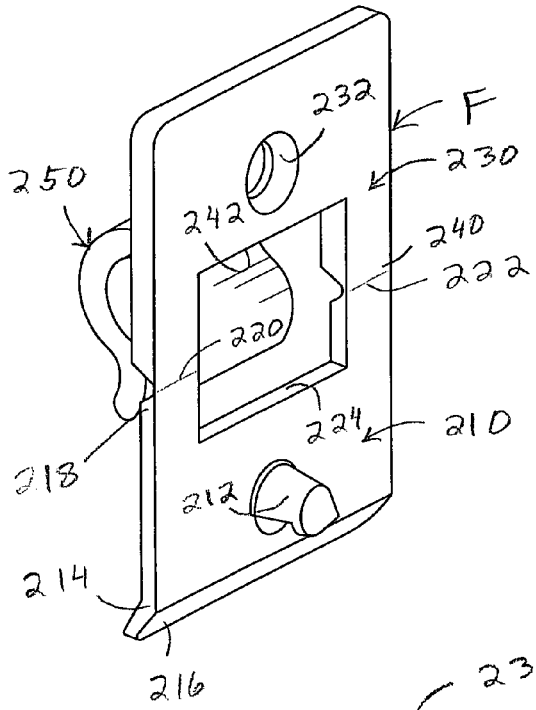
FIG. 10 is a front perspective view of a holder for planar material according to a third embodiment of the present invention.

With reference now to FIG. 10, a third embodiment of a holder F is there illustrated. This embodiment comprises a first panel 210 from which protrudes a prong 212. The first panel has a first end edge 214 adjacent which is defined a tab 216. The first panel also includes a second end edge 218 adjacent which are defined a first hinge portion 220 and, spaced therefrom, a second hinge portion 222. Spacing the two hinge portions apart is a slot 224 defined in the second end edge 218. The two hinge portions 220 and 222 connect the first panel 210 to a second panel 230. Located in the second panel is a through aperture 232. As best seen in FIG. 10, the aperture 232 extends from a first side 234 of the second panel to a second side 236 thereof. The second panel includes a first end edge 238 and a second end edge 240. Defined in the second end edge is a slot 242. The slot 242 in the second panel 230 is aligned with the slot 224 and the first panel 210.

Protruding from the second side 236 of the second panel 230 is a clip 250. The clip comprises a first portion 252 that extends approximately perpendicular to a plane of the second panel 230, a second portion 254 which is approximately semi-circular in shape which arcs back towards the second panel. A third portion 256 of the clip bends away from the second portion 254. Thus, an opening 258 is formed by the clip in relation to the second panel 230. The clip is used to enable the holder F to be mounted on a suitable conventional wire member (not illustrated) of a merchandising display. In one embodiment, the clip can be sized for mounting on a ¼ inch diameter wire. Obviously, by correctly sizing the clip, it can be mounted on any diameter wire which is used in merchandising displays.

Figure 12:
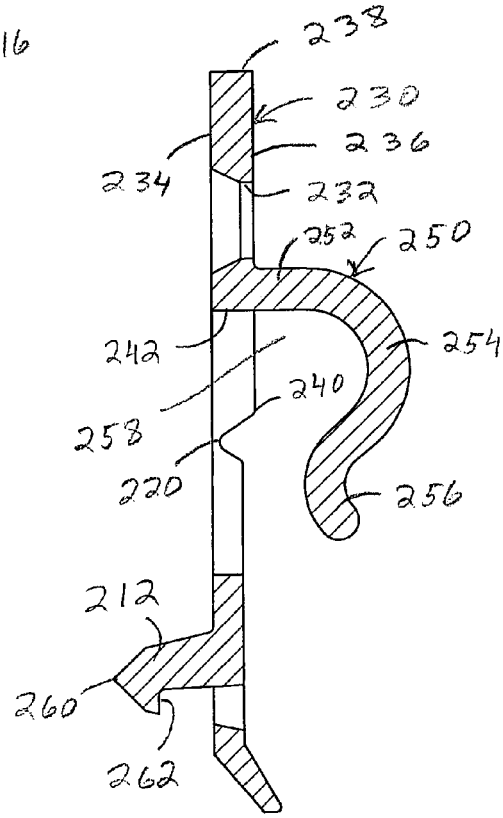
FIG. 12 is an enlarged cross sectional view of the holder of FIG. 10.

In this embodiment of the invention, the first and second panels have differing thicknesses, as can be best seen in FIG. 12. More particularly, the thickness of the first panel 210 can be, e.g., 0.060 inches, whereas the thickness of the second panel 230 can be on the order of 0.085 inches. One reason for making the second panel thicker is because it holds the clip 250. In other words, the second panel 230 has to be suitably thick so that as the clip 250 is snapped onto a wire of a merchandising display, it does not buckle either the clip or the second panel. On the other hand, the first panel, which merely needs to pivot in relation to the second panel and does not itself clip to a wire, can be thinner in order to save material. For the same reason, the aligned slots 224 and 242 can be provided in the first and second panels.

Moreover, in this embodiment, the aperture 232 extending through the second panel is not located in a thickened portion of the second panel. Thus, no shoulder is defined on the rear surface 236 of the second panel. Rather, the entire second panel is of the same thickness.

Figure 11:
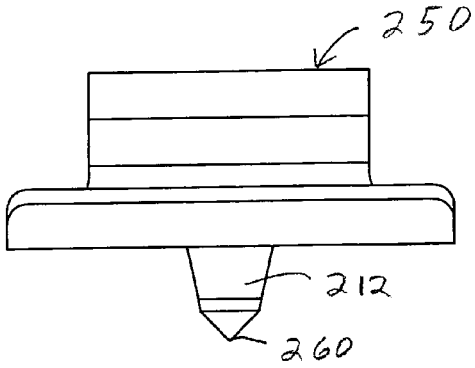
FIG. 11 is a top plan view of the holder of FIG. 10.

As with the previous embodiments, the first panel 210 is pivoted around the two hinge portions 220 and 222 so as to overlie at least a portion of the second panel 230. A sheet of planar material, such as a sign or the like (not shown), is brought adjacent the second panel 230 before the first panel is rotated. Thus, the prong 212 of the first panel would pierce the sheet and subsequently enter the aperture 232 of the second panel. In this way, the sheet is secured to the holder F. As illustrated in FIG. 11, the prong can have a pointed tip 260 to facilitate the piercing of the planar material. As is shown in FIG. 12, a shoulder 262 is defined on the prong rearwardly of the tip 260.

Figure 13:
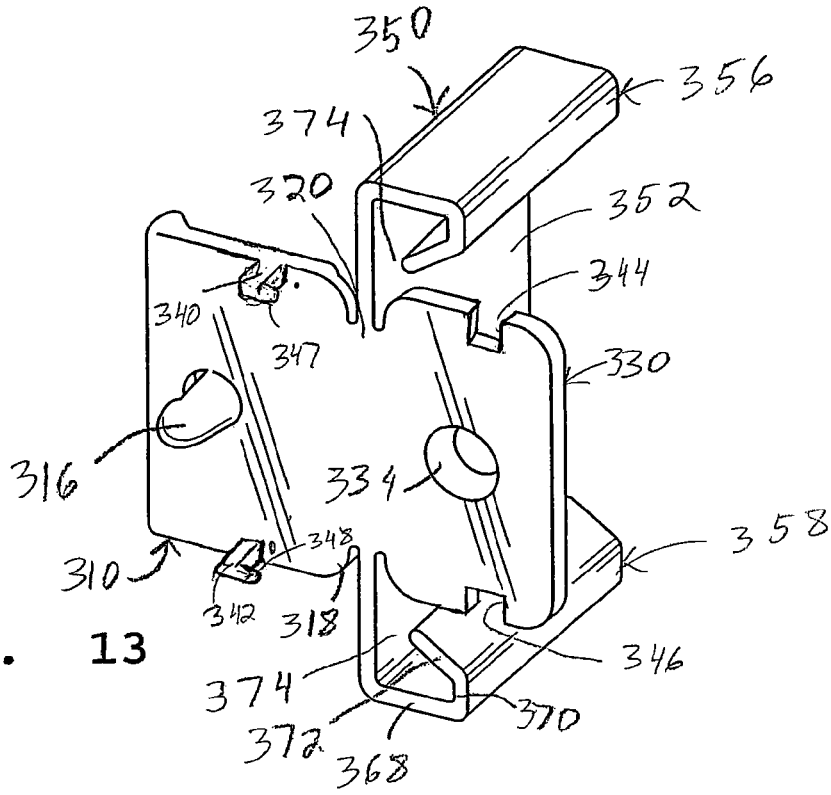
FIG. 13 is a rear perspective view of a holder for planar material according to a fourth embodiment of the present invention.

With reference now to FIG. 13, a fourth embodiment of a sign holder according to the present invention includes a first panel 310 which comprises a preferably integral prong 316 that extends approximately normal to a plane of the first panel. The first panel further comprises a second edge 318 along which is defined a hinge member 320. The hinge member 320 connects the first panel 310 to a second panel 330. Located in the second panel is an aperture 334 which extends from a front face thereof to a rear face thereof. Provided on the first panel are two additional prongs, a second prong 340 and a third prong 342. These two prongs are located adjacent opposed side edges of the first panel 310. Located on the second panel 330 are two additional apertures 344 and 346 which are meant to cooperate with the two additional prongs 340 and 342 on the first panel. Such cooperation occurs at the same time as the first prong 316 enters the first aperture 334.

In this embodiment, the first prong 316 does not need to have a shoulder. Rather, the first prong 316 can simply be in the form of a pin. To hold the first panel 310 to the second panel 330, the second and third prongs 340 and 342 can be provided with extensions 347 and 348 which are meant to lock onto a rear side of the second panel 330. Due to the resilient nature of the material from which the holder is made, the prongs simply snap fit in the apertures 344 and 346 when so desired. But, they can also be separated therefrom when the first panel 310 is pulled away from the second panel 320.

As in the embodiment of FIGS. 1-5, the holder also includes a clip 350 having first and second arms 356 and 358. For example, the second arm 358 can have a first portion 368, a second portion 370 and a third portion 372. The first clip 356 has the same three portions. The two arms each cooperate with a base wall 352 to define respective slots 374.

Figure 14:
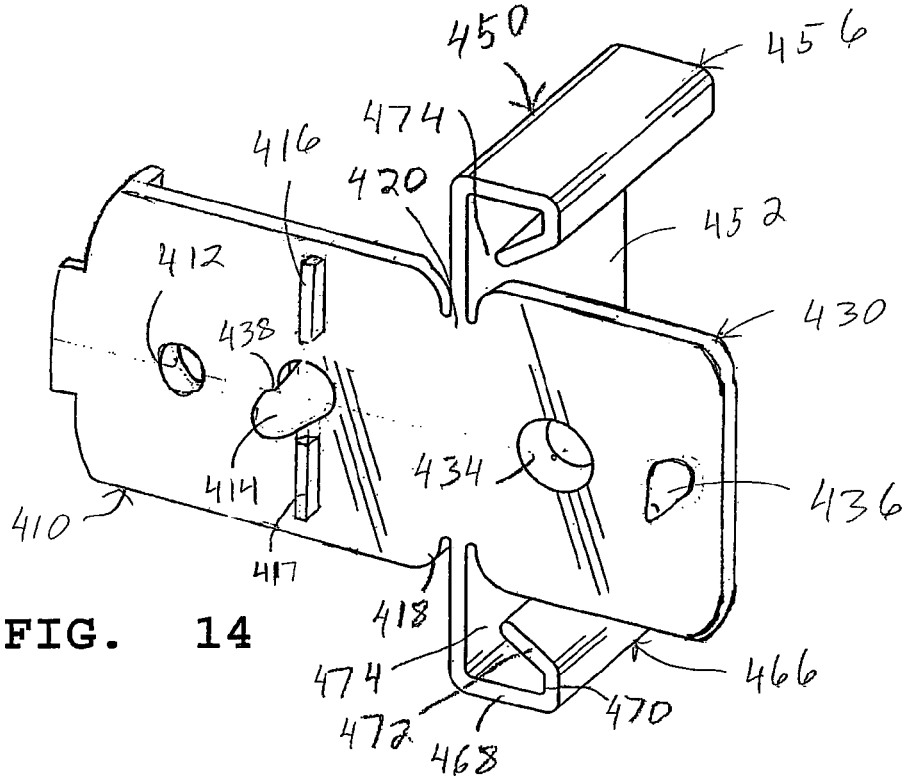
FIG. 14 is a rear perspective view of a holder for planar material according to a fifth embodiment of the present invention.

With reference now to FIG. 14, a fifth embodiment of a foldable sign holder according to the present invention is there illustrated. In this embodiment, the holder comprises a first panel 410 including a first aperture 412, a first prong 414, a first shoulder 416 and a second shoulder 417. The first and second shoulders are located on opposing sides of the first prong 414. The first panel 410 further comprises a second end edge 418 along which is defined a hinge member 420. If so desired, the hinge member 420 can be a living hinge. The hinge member 420 connects the first panel 410 to a second panel 430.

Located in the second panel 430 is a second aperture 434. Also located on the second panel is a second prong 436. Unlike the first prong 414 which has a shoulder 438, along the lines of the shoulder 60 illustrated in FIG. 5, the second prong 436 is conically shaped and does not have a shoulder. In this design, when the first panel 410 is folded over onto the second panel 430, the first prong 414 extends through the second aperture 434, whereas the second prong 436 extends through the first aperture 412.

Sheet material can be butted up against the shoulders 416 and 417 such that only the second prong 436 extends through the sheet material. But, it is also possible to butt the sheet material up against the hinge 420 so that both prongs 414 and 436 extend through the sheet material. This would allow the sheet material to be more firmly held by the foldable sign holder.

Also provided for the foldable sign holder is a clip 450. The clip includes a base wall 452. Positioned on a first end of the base wall 452 is a first arm 456. Positioned on a second end of the base wall is a second arm 466. The arms 456 and 466 can be of the same type as previously discussed. For example, the second arm 466 can include a first portion 468, a second portion 470 and a third portion 472. The two arms 456 and 466, together with the base wall 452, define respective slots 474.

While five different designs of sheet material holders have been illustrated in this specification, it should be appreciated that a variety of other types of holders is also contemplated herein and would be apparent to one of ordinary skill in the art. As noted, the sheet-pinning function and the panel-holding function can be performed by the same prong (FIGS. 1-12) or prongs (FIG. 13) or by two separate prongs (FIGS. 13 and 14). Of course, other designs are also contemplated. The term "prong" should be given a broad definition and is meant to include any type of pointed projection, pin, tine, fork or the like. Similarly, the term "aperture" is to be given a broad definition and includes any type of hole, gap, slit, orifice or other opening in or through a panel, whether at an edge of a panel (FIG. 13) or through a relatively central part thereof.

The invention has been described with reference to several embodiments. Obviously, modifications and alterations will occur to others upon a reading and understanding of this specification. It is intended to include all such modifications and alterations in so far as they come within the scope of the appended claims or the equivalents thereof.

The invention claimed is:

1. A sign holder, comprising:

a first panel;

a second panel hingedly connected to said first panel;

a prong secured to said first panel and extending in a direction approximately normal thereto, said prong having a pointed tip;

an aperture defined in said second panel, wherein said pointed tip pierces an associated sign so that said prong of said first panel can pass through the associated sign and enter said aperture of said second panel when said first panel overlies a portion of said second panel thereby holding the associated sign between said first and second panels;

an extension connected to at least one of said first and second panels, said extension allowing the holder to be mounted to an associated support, wherein said extension comprises a first semicircular member extending away from a plane of said first panel;

a second semicircular member extending away from a plane of said second panel; and, a bracing member extending approximately perpendicularly from one of said first and second panels for locating an edge of the associated sign selectively held between said first and second panels, wherein said one of said first and second panels is planar.

2. The holder of claim 1 wherein said extension comprises:

a clip.

3. The holder of claim 1 wherein said first panel comprises a tab extending away from a plane of said first panel, said tab being manually graspable.

4. The holder of claim 1 wherein said prong includes a shoulder defined rearwardly of said tip, wherein said prong shoulder cooperates with a rear side of said second panel to hold said prong in said second panel.

5. The holder of claim 4 wherein said second panel comprises a shoulder defined adjacent said aperture, said prong shoulder contacting said panel shoulder when said prong extends through said aperture.

6. A holder for planar material, comprising:

a first panel;

a second panel hingedly connected to said first panel;

a prong secured to said first panel and extending in a direction approximately normal thereto, said prong having a pointed tip;

an aperture defined in said second panel, wherein said pointed tip pierces an associated planar material so that said prong of said first panel can pass through the associated planar material and enter said aperture of said second panel when said first panel overlies a portion of said second panel thereby holding the associated planar material between said first and second panels;

a clip connected to at least one of said first and second panels, said clip allowing the holder to be mounted to an associated support, wherein said clip comprises a base and a pair of arms extending away from a plane of said base, wherein said base is oriented in a direction approximately perpendicular to said second panel; and, a ramp extending from adjacent a first side wall of the base towards a second side wall thereof, said ramp enabling said clip to frictionally engage the associated support.

7. The holder of claim 6 wherein said ramp includes a first, lower, end located adjacent said first side wall of said base and a second, higher, end located adjacent said second side wall of said base.

8. The holder of claim 7 wherein said ramp second end is connected to said second panel.

9. The holder of claim 6 wherein said prong extends from a first side of said first panel and said clip extends from a second side of said second panel.

10. The holder of claim 9 wherein said clip is approximately C-shaped in cross section.

11. The holder of claim 9 wherein said first panel is thinner than said second panel.

12. The holder of claim 9 wherein said clip is positioned on said second panel adjacent said aperture in said second panel.

13. A sign holder comprising:

a first panel including a first extension;

a second panel including a second extension wherein said first and second panels are planar;

a hinge connecting said first and second extensions thereby allowing said first panel, and said first extension, to be pivoted in relation to said second panel, and said second extension, wherein said first and second extensions cooperate to form an approximately circular opening thus enabling the holder to be selectively mounted on a wire component of an associated support;

a first reinforcing rib protruding from at least one of said first panel, said first extension, said second panel and said second extension;

a prong protruding from said first panel;

an aperture extending through said second panel, wherein said prong pierces an associated sign and extends into said aperture when said first panel is pivoted in relation to said second panel; and, a bracing wall extending from said second panel for locating an edge of the associated sign selectively held between said first and second panels.

14. The holder of claim 13 wherein said first reinforcing rib protrudes from at least one of said first panel and said first extension and further comprising a second reinforcing rib protruding from at least one of said second panel and said second extension.

15. The holder of claim 14 wherein said first and second reinforcing ribs are aligned with each other.

16. The holder of claim 14 wherein said first and second reinforcing ribs are oriented parallel to a longitudinal axis of the holder.

17. The holder of claim 14 further comprising:

a third rib protruding from at least one of said first panel and said first extension; in spaced relation to said first rib; and, a fourth rib protruding from at least one of said second panel and said second extension, in spaced relation to said second rib.

18. The holder of claim 17 wherein said first and third ribs are positioned adjacent opposed side edges of said first extension; and wherein said second and fourth ribs are positioned adjacent opposed side edges of said second extension.

19. The holder of claim 13 further comprising a lock for maintaining said prong in said aperture, said lock comprising:

a shoulder formed on said prong, said shoulder cooperating with a rear surface of said second panel adjacent said aperture.

20. A holder for planar material comprising:

a first panel extending in a first plane;

a first extension connected to said first panel and protruding away from said first plane;

a prong secured to said first panel and protruding therefrom;

a second panel extending, in a first orientation, in said first plane;

a second extension connected to said second panel and protruding away from said first plane;

an aperture defined in said second panel;

a hinge connecting said first and second extensions thereby allowing said first panel, and said first extension, to be pivoted in relation to said second panel, and said second extension by approximately 180° from said first orientation to a second orientation so that said prong can pass through an associated planar material and enter said aperture of said second panel, thereby holding the associated planar material between said first and second panels;

wherein said first and second extensions cooperate to form an approximately circular opening which enables the holder to be suspended from a wire element of an associated support; and, a bracing wall extending from one of said first and second panels for locating an edge of an associated sign selectively held between said first and second panels.

21. The holder of claim 20 further comprising:

a first reinforcing rib protruding from at least one of said first panel and said first extension; and, a second reinforcing rib protruding from at least one of said second panel and said second extension.

22. A sign holder comprising:

a first panel;

a second panel hingedly connected to said first panel;

a prong secured to said first panel and extending in a direction approximately normal thereto, said prong having a pointed tip;

an aperture defined in said second panel, wherein said pointed tip pierces an associated sign so that said prong of said first panel can pass through the associated sign and enter said aperture of said second panel when said first panel overlies a portion of said second panel thereby holding the associated sign between said first and second panels; and, a clip connected to at least one of said first and second panels, said clip allowing the holder to be mounted to an associated support, wherein said clip comprises a first portion which extends approximately perpendicular to a plane of said second panel, a second portion which extends approximately perpendicular to a plane of said first portion, and is oriented approximately perpendicular to said plane of said second panel, and a third portion.

23. The sign holder of claim 22 further comprising a tab extending away from one of a plane of said first panel or a plane of said second panel, said tab being manually graspable.

24. The sign holder of claim 22 further comprising a bracing member extending away from one of said first and second panels for locating an edge of an associated sign selectively held between said first and second panels.

* * * * *